US011459923B2

(12) United States Patent
Ahmed

(10) Patent No.: US 11,459,923 B2
(45) Date of Patent: Oct. 4, 2022

(54) SMOKELESS EXHAUST TUBE

(71) Applicant: QATAR UNIVERSITY, Doha (QA)

(72) Inventor: Samer Ahmed, Doha (QA)

(73) Assignee: QATAR UNIVERSITY, Doha (QA)

( * ) Notice: Subject to any disclaimer, the term of this patent is extended or adjusted under 35 U.S.C. 154(b) by 0 days.

(21) Appl. No.: 16/840,905

(22) Filed: Apr. 6, 2020

(65) Prior Publication Data

US 2021/0310388 A1 Oct. 7, 2021

(51) Int. Cl.

| | |
|---|---|
| ***F01N 3/021*** | (2006.01) |
| ***F01N 3/04*** | (2006.01) |
| ***F01P 11/02*** | (2006.01) |
| ***F01P 3/12*** | (2006.01) |

(52) U.S. Cl.

CPC ..... *F01N 3/021* (2013.01); *F01N 3/043* (2013.01); *F01P 3/12* (2013.01); *F01P 11/0204* (2013.01); *F01P 11/0276* (2013.01); *F01N 2260/024* (2013.01)

(58) Field of Classification Search

CPC .... F01N 3/021; F01N 3/043; F01N 2260/024; F01P 11/0276; F01P 11/0204; F01P 3/12

See application file for complete search history.

(56) References Cited

U.S. PATENT DOCUMENTS

| | | | | |
|---|---|---|---|---|
| 3,664,135 A | | 5/1972 | Lirette | |
| 3,817,222 A | | 6/1974 | Staib | |
| 5,121,602 A | | 6/1992 | McCorvey | |
| 5,129,926 A | * | 7/1992 | Harwell | F02M 26/36 96/353 |
| 5,135,551 A | | 8/1992 | Fielding | |
| 5,453,107 A | * | 9/1995 | Liu | B01D 47/021 95/228 |
| 2003/0010214 A1 | * | 1/2003 | Naruke | F01N 13/009 96/337 |
| 2003/0209256 A1 | * | 11/2003 | Tadayon | F04D 29/70 134/10 |
| 2004/0118111 A1 | * | 6/2004 | Covit | F01N 3/0892 60/300 |
| 2005/0022668 A1 | * | 2/2005 | Cairns | F01N 3/04 95/226 |

FOREIGN PATENT DOCUMENTS

| | | |
|---|---|---|
| CN | 1455078 A | 11/2003 |
| CN | 106930807 A | 7/2017 |
| CN | 206972333 U | 2/2018 |

* cited by examiner

*Primary Examiner* — Mahmoud Gimie
*Assistant Examiner* — Diem T Tran
(74) *Attorney, Agent, or Firm* — Squire Patton Boggs (US) LLP

(57) ABSTRACT

A method filtering exhaust gas may include attaching an exhaust tube to an engine at an exhaust gas inlet of the exhaust tube. The method may also include filling an outer tube of the exhaust tube with a liquid. The method may further include filtering the exhaust gas by passing the exhaust gas through an inner gas distributor disposed inside the outer tube, and through a plurality of holes of the inner gas distributor into the liquid of the outer tube. In addition, the method may include expelling filtered exhaust gas through an exhaust gas outlet of the exhaust tube.

12 Claims, 15 Drawing Sheets

SMOKELESS EXHAUST TUBE

FIELD

Some embodiments may generally relate to internal combustion engine emissions control systems. More specifically, certain embodiments may relate to a device and method for removing smoke from the exhaust of equipment and engines such as, for example, diesel engines.

BACKGROUND

Emissions from diesel engines are considered a major source of pollution worldwide. Smoke emissions, in particular, may be detrimental to human health, and may cause severe diseases such as cancer and asthma. Currently, certain countries have considered banning diesel trucks and vehicles from entering certain cities in an effort to minimize smoke emissions. However, since diesel vehicles are essential to the world's economy, banning such vehicles may not be a viable solution. In view of these challenges, there is a need to provide a smokeless exhaust tube that is capable of eliminating the smoke emissions of vehicles including, for example, vehicles equipped with diesel engines.

SUMMARY

Certain embodiments may be directed to a method for filtering exhaust gas. The method may include attaching an exhaust tube to an engine at an exhaust gas inlet of the exhaust tube. The method may further include filling an outer tube of the exhaust tube with a liquid. The method may also include filtering the exhaust gas by passing the exhaust gas through an inner gas distributor disposed inside the outer tube, and through a plurality of holes of the inner gas distributor into the liquid of the outer tube. In addition, the method may include expelling filtered exhaust gas through an exhaust gas outlet of the exhaust tube.

Other embodiments may be directed to an exhaust tube. The exhaust tube may include an exhaust gas inlet on a first end of the exhaust tube. The exhaust tube may also include an exhaust gas outlet on a second end of the exhaust tube opposite the first end. The exhaust tube may further include an outer tube disposed between the exhaust gas inlet and the exhaust gas outlet. In addition, the exhaust tube may include an inner gas distributor disposed inside the outer tube.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings:

FIG. 3(*b*) illustrates an inner gas distributor of the smokeless exhaust tube, according to certain embodiments.

FIG. 3(*c*) illustrates an exit elbow of the smokeless exhaust tube, according to certain embodiments.

FIG. 3(*d*) illustrates a cooling coil of the smokeless exhaust tube, according to certain embodiments.

FIG. 3(*e*) illustrates a radiator connected to the smokeless exhaust tube, according to certain embodiments.

DETAILED DESCRIPTION

It will be readily understood that the components of certain example embodiments, as generally described and illustrated in the figures herein, may be arranged and designed in a wide variety of different configurations. The following is a detailed description of some embodiments for removing smoke from the exhaust of engines such as, for example, diesel engines.

The features, structures, or characteristics of example embodiments described throughout this specification may be combined in any suitable manner in one or more example embodiments. For example, the usage of the phrases "certain embodiments," "an example embodiment," "some embodiments," or other similar language, throughout this specification refers to the fact that a particular feature, structure, or characteristic described in connection with an embodiment may be included in at least one embodiment. Thus, appearances of the phrases "in certain embodiments," "an example embodiment," "in some embodiments," "in other embodiments," or other similar language, throughout this specification do not necessarily all refer to the same group of embodiments, and the described features, structures, or characteristics may be combined in any suitable manner in one or more example embodiments.

Additionally, if desired, the different functions or steps discussed below may be performed in a different order and/or concurrently with each other. Furthermore, if desired, one or more of the described functions or steps may be optional or may be combined. As such, the following description should be considered as merely illustrative of the principles and teachings of certain example embodiments, and not in limitation thereof.

As discussed herein, certain embodiments may provide a smokeless exhaust tube that is capable of completely (100%) eliminating the smoke emissions of an internal combustion engine including, for example, a compression ignition diesel engine or a spark ignition gasoline engine of any trucks, buses or other types of motor vehicles, and various motorized equipment, such as construction equipment (Grader, Bulldozer, etc.). Certain embodiments may also decrease other emissions including, for example, nitrogen oxides ($NO_x$), carbon monoxide (CO), carbon dioxide ($CO_2$), and unburnt hydrocarbons (HC). For instance, according to certain embodiments, these other emissions may be decreased by about 20-25%.

Figure 1:
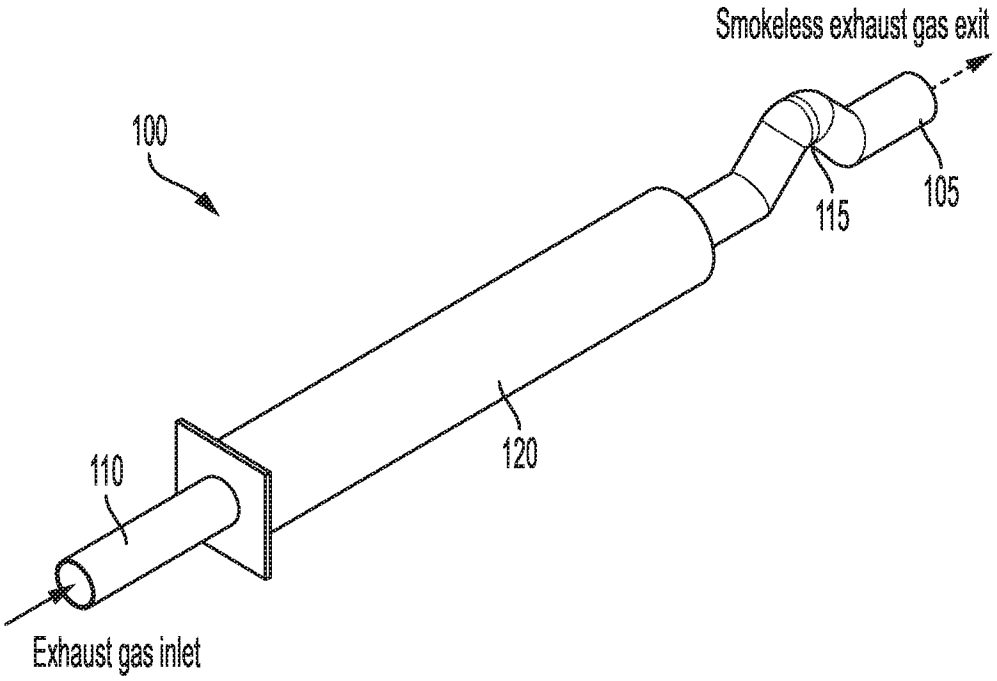
FIG. 1 illustrates an outer shape of a smokeless exhaust tube, according to certain embodiments.

FIG. 1 illustrates an outer shape of a smokeless exhaust tube, according to certain embodiments. According to certain embodiments, the smokeless exhaust tube 100 may include an outer tube 120 that has a diameter of about 100 mm (10 cm), and a length of about 1,250 mm (1.25 m). As illustrated in FIG. 1, the smokeless exhaust tube 100 may also be connected from both sides with a normal exhaust pipe of the vehicle including, for example, at an exhaust gas exit end 105 and an exhaust gas inlet end 110. In certain embodiments, the inlet exhaust gas from the engine may pass through an inner gas distributor 205 (FIG. 2) of the smokeless exhaust tube 100. According to certain embodiments, the inner gas distributor 205 may be about a 1,000 mm-long hollow cylindrical pipe with a diameter of about 20 mm.

Figure 2:
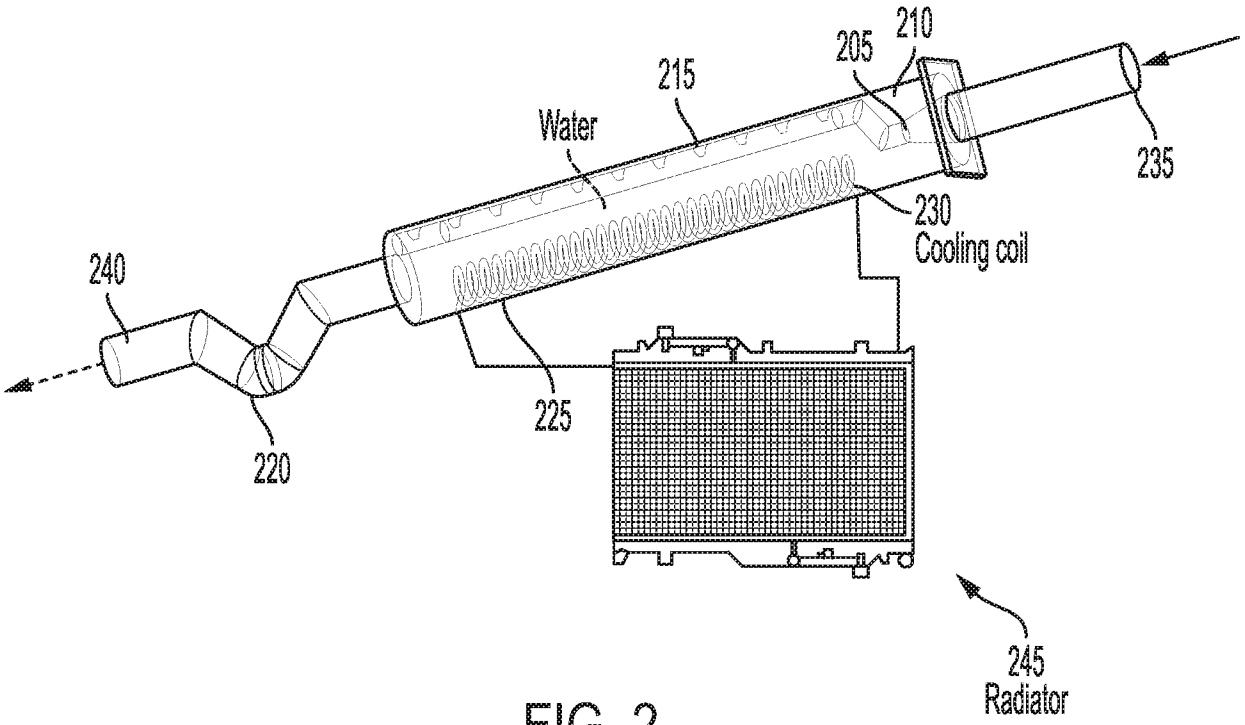
FIG. 2 illustrates a schematic diagram of the internal design of the smokeless exhaust tube, according to certain embodiments.
Figure 3B:
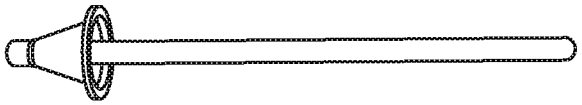
FIG. 3(*a*) illustrates an outer tube of the smokeless exhaust tube, according to certain embodiments.
Figure 3C:
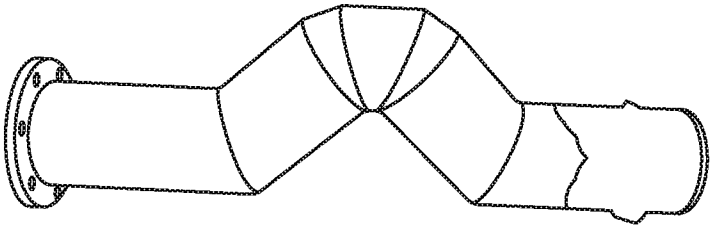
Figure 3A:
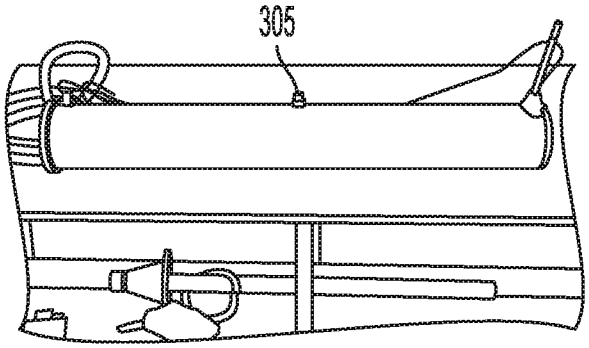
Figure 3E:
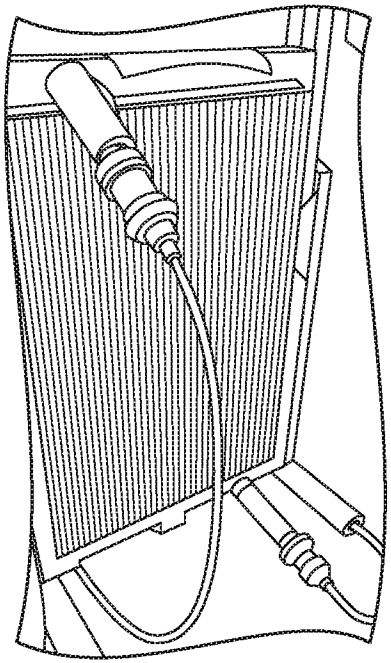
Figure 3D:
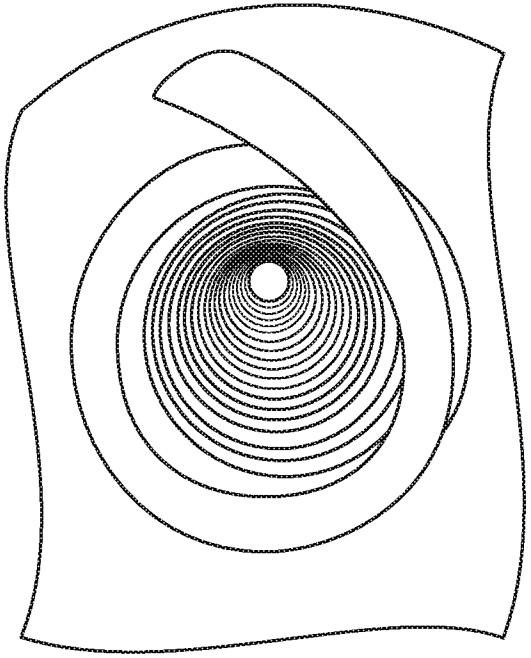

FIG. 2 illustrates a schematic diagram of the internal design of the smokeless exhaust tube, according to certain embodiments. As illustrated in FIG. 2, the whole volume inside an outer tube 210 of the smokeless exhaust tube 100 may be filled with a liquid. In certain embodiments, the liquid may be water, and the amount of water contained in the outer tube 210 may be about 23 liters. In further embodiments, the inner gas distributor may have ten 5 mm holes 215. However, in other embodiments, the inner gas distributor 205 may have more or less than ten holes. According to certain embodiments, the exhaust gas from the engine may pass through the holes 215 of the inner gas distributor to bubble water in the outer tube 210 before exiting the outer tube 210. In certain embodiments, the water may be prevented from spilling out of the outer tube 210 by an elbow 115, 220. According to certain embodiments, the elbow 220 may have a height of about 30 cm at the exit of the outer tube 210. However, if the outer tube 210 is installed in the exhaust system of the vehicle, the elbow 220 may not be needed. This is at least because the smokeless exhaust tube would be placed vertically to allow the exhaust gas to exit from the top of the vehicle in order not to create bad pollution within the ground level. According to certain embodiments, all the components of the smokeless exhaust tube 100 may be made from stainless steel to avoid being rusted by water.

In certain embodiments, the water inside the outer tube 210 may be cooled by a cooling system 225, which may include a cooling coil 230 made from copper to enhance the heat transfer from the water. The cooling coil 230 may be connected to a radiator 245 to exchange the heat with the surrounding air. In addition, the cooling system 230 may use water to cool down the water in the outer tube 210. According to certain embodiments, there is no mixing between the water of the cooling system 230 and the water inside the outer tube 210, as illustrated in FIG. 2.

According to certain embodiments, it may not be necessary to install the radiator 245 since an existing radiator of the vehicle may be utilized to cool the water of the outer tube 210, as the cooling load may not be that high. In certain embodiments, to effectively make use of the existing radiator, the existing radiator should be capable of cooling down the engine water and the outer tube 210 water. In other embodiments, the radiator size of the vehicle may be increased slightly, but not more than 10% of its current size. Alternatively, in other embodiments, a small radiator may be installed somewhere on the vehicle body for this purpose.

FIG. 3(*a*) illustrates the outer tube of the smokeless exhaust tube, according to certain embodiments. Further, FIG. 3(*b*) illustrates the inner gas distributor of the smokeless exhaust tube, according to certain embodiments. FIG. 3(*c*) illustrates the exit elbow of the smokeless exhaust tube, according to certain embodiments. In addition, FIG. 3(*d*) illustrates the cooling coil of the smokeless exhaust tube, according to certain embodiments. Further, FIG. 3(*e*) illustrates the radiator connected to the smokeless exhaust tube, according to certain embodiments. As illustrated in FIGS. 3(*a*)-3(*e*), the outer tube 210 may be equipped with two thermocouples at an inlet 235 and outlet 240 to monitor the water temperatures in the outer tube 210 to ensure that the temperatures are below the evaporation temperature.

According to certain embodiments, the outer tube 210 may include two holes. For example, the outer tube 210 may include one hole at the top 305, and one hole at the bottom opposite the top hole (not shown). In certain embodiments, the hole at the top may be used to fill the outer tube 210 with fresh water, while the bottom hole may be used to drain the contaminated water. According to certain embodiments, any type of water may be used inside the outer tube 210 including, for example, treated sewage water.

Figure 4:
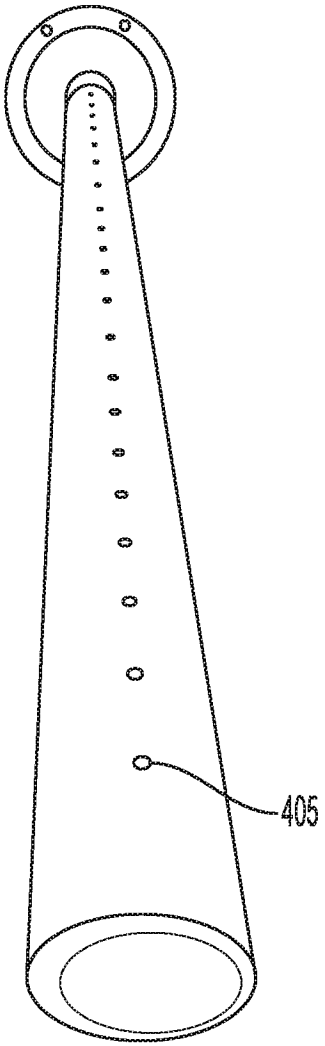
FIG. 4 illustrates holes in the inner gas distributor of the smokeless exhaust tube, according to certain embodiments.

FIG. 4 illustrates holes in the inner gas distributor of the smokeless exhaust tube, according to certain embodiments. According to certain embodiments, the holes 405 illustrated in FIG. 4 may enable the smokeless exhaust tube to pass the smoky exhaust gas through a maximum amount of water and, at the same time, not create a high pressure drop on the engine. Further, in certain embodiments, the holes 405 may vary in size, and the distribution of the holes 405 may not be limited to the design illustrated in FIG. 4. For example, the distribution of the holes 405 may have a diameter size of about 5 to 10 mm each, and they may be varied to achieve a certain target (e.g., certain exhaust gas flow rates for different engine sizes). According to certain embodiments, the separation distance between the holes may depend on the engine size. For example, the configuration of the holes may remain the same. However, the number and the size of the holes may depend on the engine size or equipment size. For example, in certain embodiments, the size of the outer tube for a 4-cylinder engine may be different from the size of the outer tube for a 6-cylinder engine.

Figure 5:
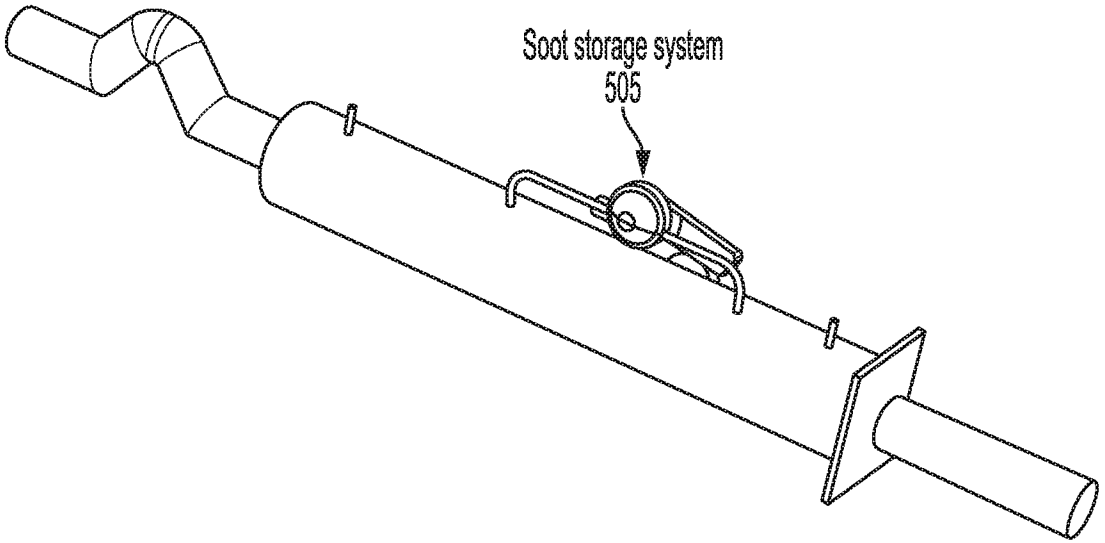
FIG. 5 illustrates a soot storage system added to the smokeless exhaust tube, according to certain embodiments.

FIG. 5 illustrates a soot storage system added to the smokeless exhaust tube, according to certain embodiments. As described above, the water inside the outer tube may need to be changed to replace the contaminated soot water with fresh water. As illustrated in FIG. 5, this process may be improved by adding another system outside the outer tube to hold the soot particles contained in the contaminated water. For instance, as illustrated in FIG. 5, a separate external container 505 may be attached to the exterior surface of the outer tube to hold the soot particles. This enables the outer tube to use the water contained therein for an extended period of time as compared to if the smokeless exhaust tube did not have the separate external container 505 installed.

According to certain embodiments, the external container 505 may use a hydro-cyclone device to separate the solid particles of the smoke from the water by way of centrifugal force. In particular, the external container 505 may work with a small centrifugal pump to recirculate the contaminated water inside the outer tube through the hydro-cyclone device. In certain embodiments, the hydro-cyclone device may be provide with a container to store the soot particles after separation. Then, this container may be cleaned in a similar manner as an air filter of the engine during the regular maintenance of the vehicle.

According to certain embodiments, the smokeless exhaust tube may be tested experimentally on a single-cylinder diesel-engine test bed. Here, the exhaust manifold may be connected with the smokeless exhaust tube. In addition, three thermocouples may be used and coupled to the smokeless exhaust tube at three separate locations including at the engine, inlet of the smokeless exhaust tube, and exit of the smokeless exhaust tube. These thermocouples may measure the exhaust gas temperature out of the engine, the water temperature at the inlet of the smokeless exhaust tube, and the water temperature at the exit of the smokeless exhaust tube. Furthermore, the smoke and emissions of the exhaust gas out of the smokeless exhaust tube may be measured by using an advanced gas analyzer and a smoke meter. The obtained results may be compared with those of the engine under normal operation (reference case) without using the smokeless exhaust tube.

Figure 6:
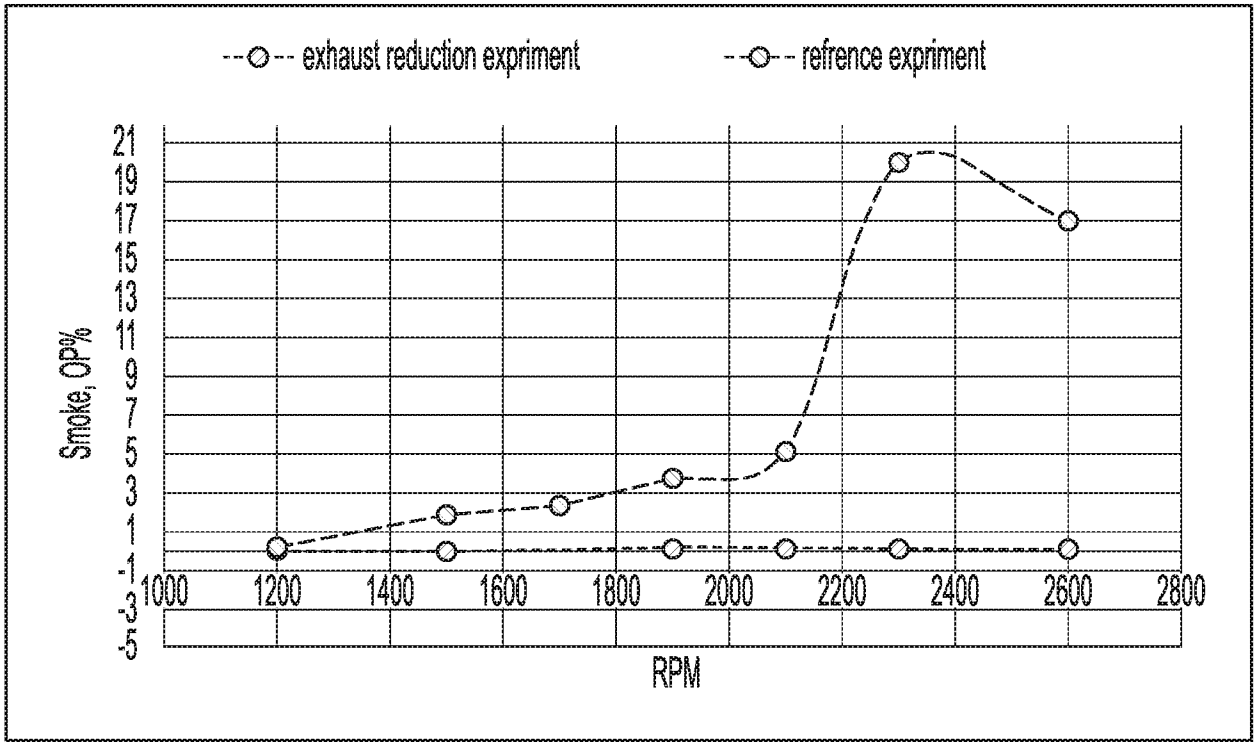
FIG. 6 illustrates an exhaust smoke intensity of a diesel engine with and without (reference case) installing the smokeless exhaust tube, according to certain embodiments.

FIG. 6 illustrates an exhaust smoke intensity of a diesel engine with and without (reference case) installing the smokeless exhaust tube, according to certain embodiments. In particular, FIG. 6 illustrates a comparison of the smoke intensity of the exhaust gas of the engine with and without using the smokeless exhaust tube as a function of engine speed. As can be seen from FIG. 6, the smoke intensity increases with the engine speed under normal operation of the engine. However, when the smokeless exhaust tube is used, the smoke intensity is "zero" in the entire range of engine speeds. In other words, with the smokeless exhaust tube installed, may be possible to remove all of the smoke particles by capturing all of the smoke particles by the water. According to the experiment illustrated in FIG. 6, a clean and transparent exhaust gas was observed out of the smokeless exhaust tube, similar to that of a regular gas engine.

Figure 7:
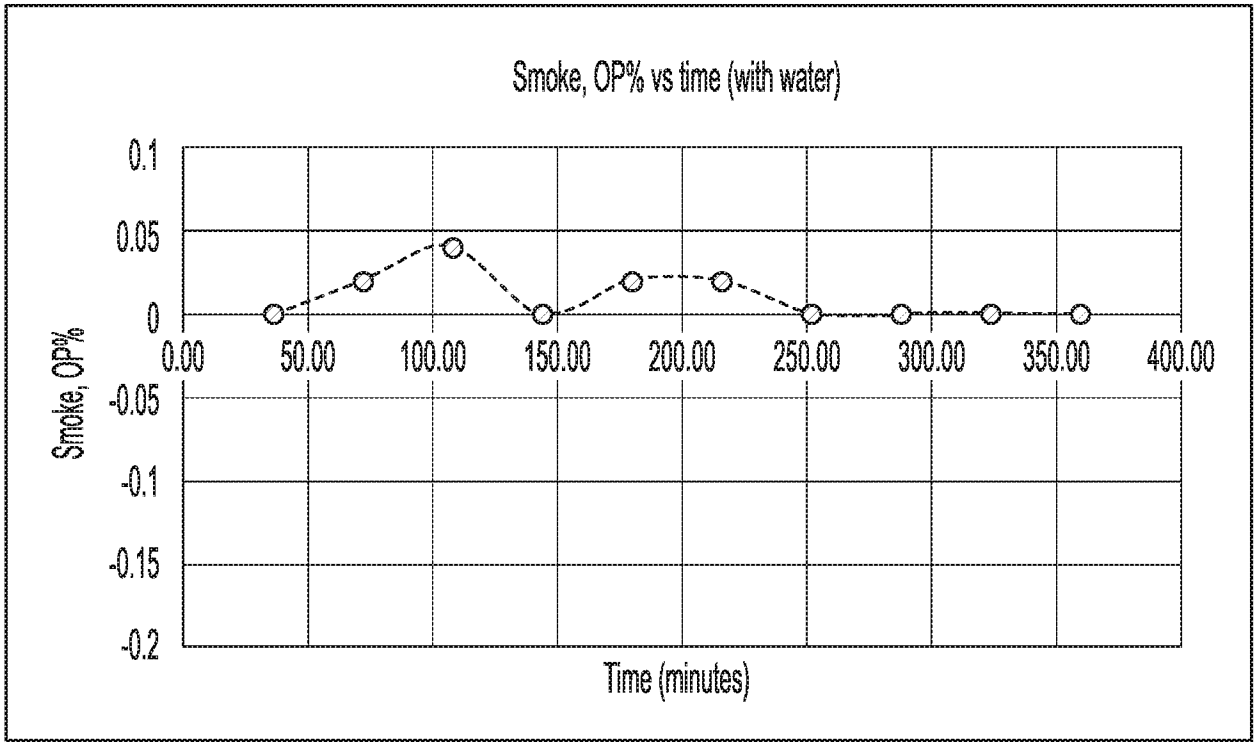
FIG. 7 illustrates measurements of the exhaust smoke intensity of a diesel engine when using the smokeless exhaust tube for more than 6 hours of continuous operation, according to certain embodiments.

FIG. 7 illustrates measurements of the exhaust smoke intensity of a diesel engine when using the smokeless exhaust tube for more than 6 hours of continuous operation, according to certain embodiments. In this experiment, the smoke intensity of the engine was measured with the smokeless exhaust tube in-use for more than 6 hours of continuous engine operation. This experiment was also useful in showing whether the water inside the outer tube will evaporate or not. In addition, it provides information about the capability of the smokeless exhaust tube to capture the carbon particles of the smoke for an extended period of time. For instance, as illustrated in FIG. 7, even after 6 hours of continuous operation, the smoke intensity remained at zero, which means that no smoke out of the engine. Although the smoke intensity may show slightly higher values than zero in FIG. 7 at certain operation periods, this may be due to experimental measurement errors because the values illustrated in FIG. 7 do not exceed 0.05% compared to 3%, which was the minimum smoke intensity when the smokeless exhaust tube was not used.

Figure 8:
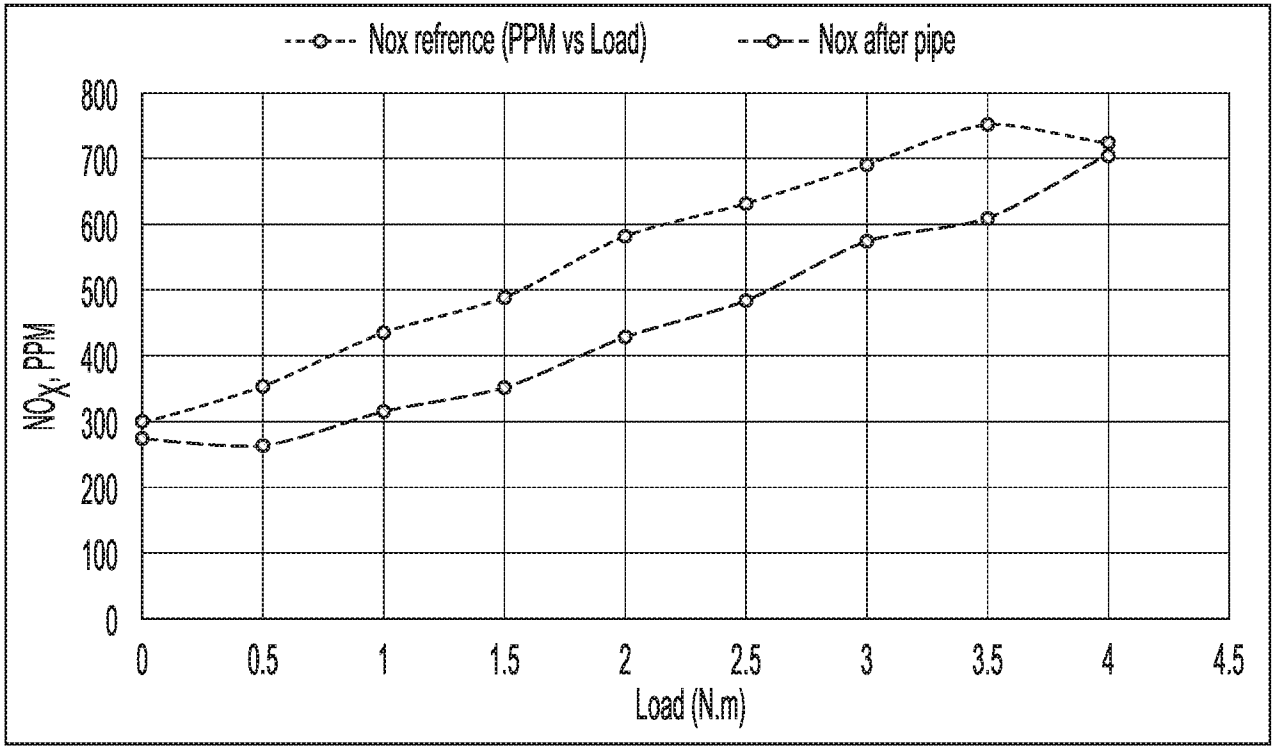
FIG. 8 illustrates $NO_x$ emissions of a diesel engine with and without installing the smokeless exhaust tube, according to certain embodiments.

FIG. 8 illustrates $NO_x$ emissions of a diesel engine with and without installing the smokeless exhaust tube, according to certain embodiments. As previously noted, according to certain embodiments, the smokeless exhaust tube may decrease other important diesel emissions. For instance, $NO_x$ emissions may be decreased. As illustrated in FIG. 8, when the smokeless exhaust tube was used, $NO_x$ emissions decreased about 20% compared to the reference case over the entire range of the engine operation. This may be a result of the reaction rate between $O_2$ and $N_2$ decreases when the exhaust gas cools down by passing through the water in the outer tube. In certain embodiments, this type of reaction increases with the increase in temperature.

Figure 9:
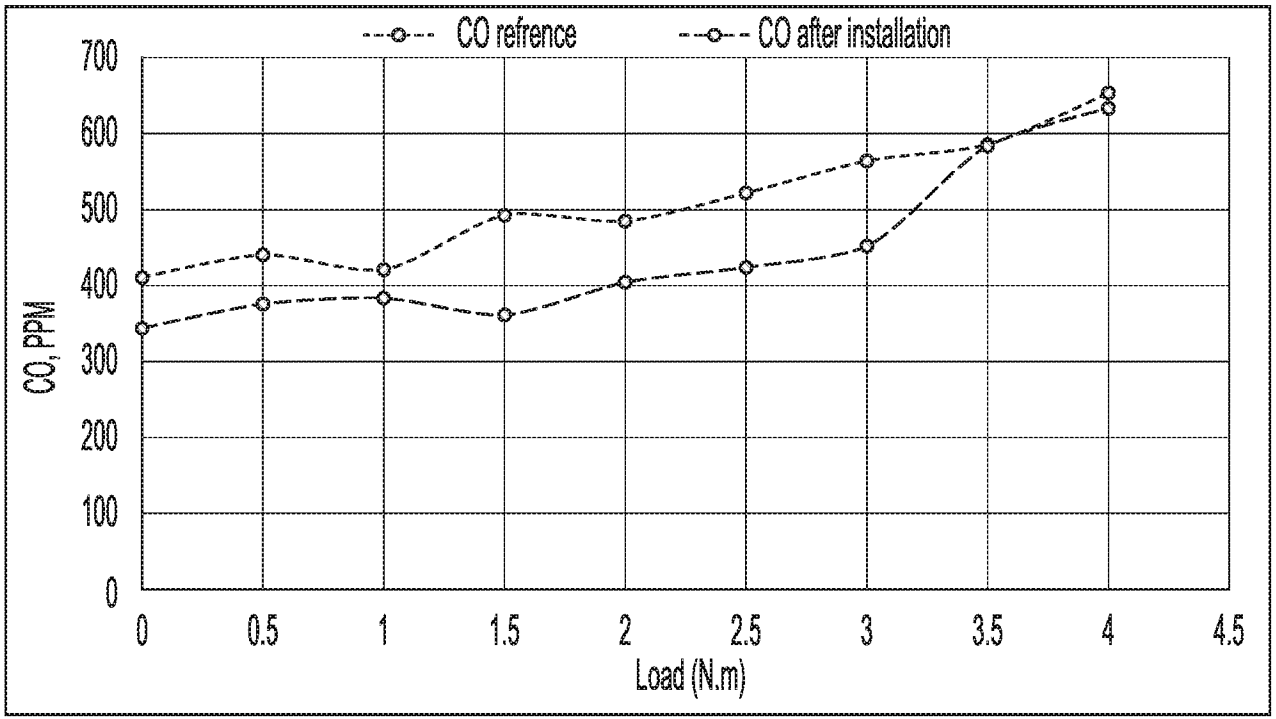
FIG. 9 illustrates carbon monoxide (CO) emissions of the diesel engine with and without installing the smokeless exhaust tube, according to certain embodiments.
Figure 10:
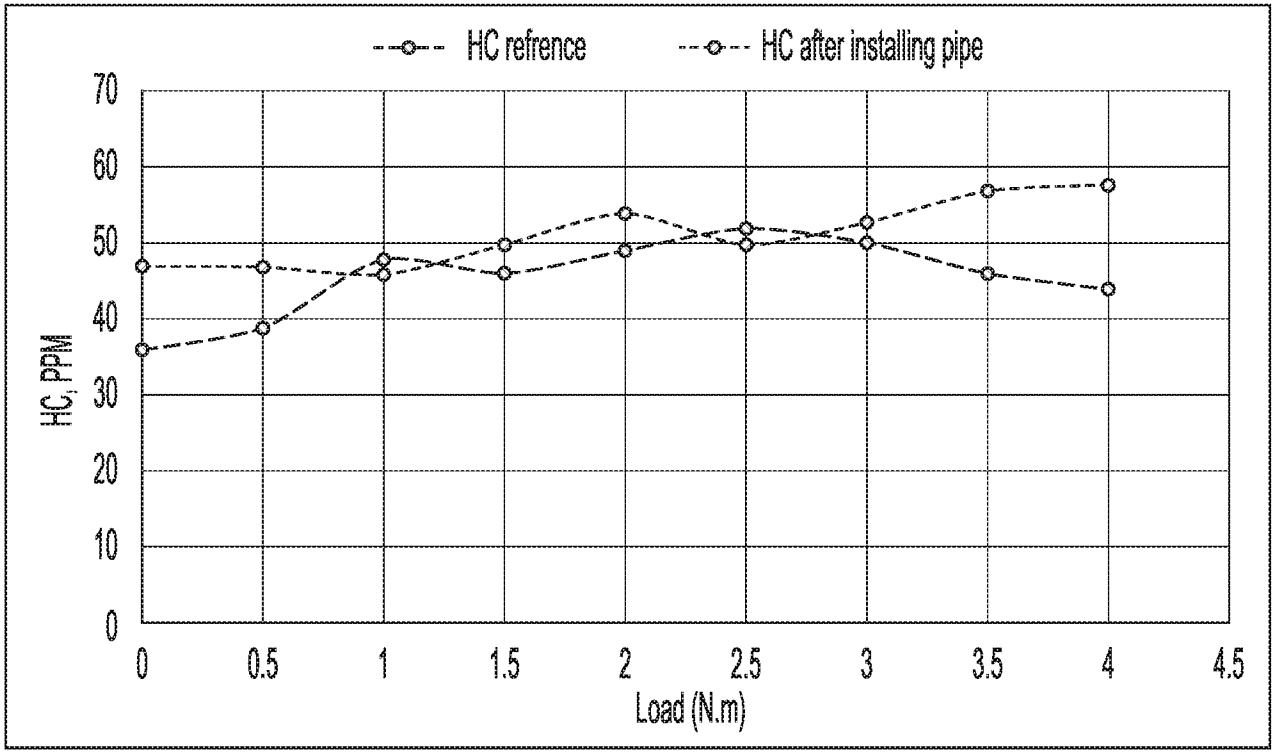
FIG. 10 illustrates hydrocarbon (HC) emissions of the diesel engine with and without installing the smokeless exhaust tube, according to certain embodiments.
Figure 11:
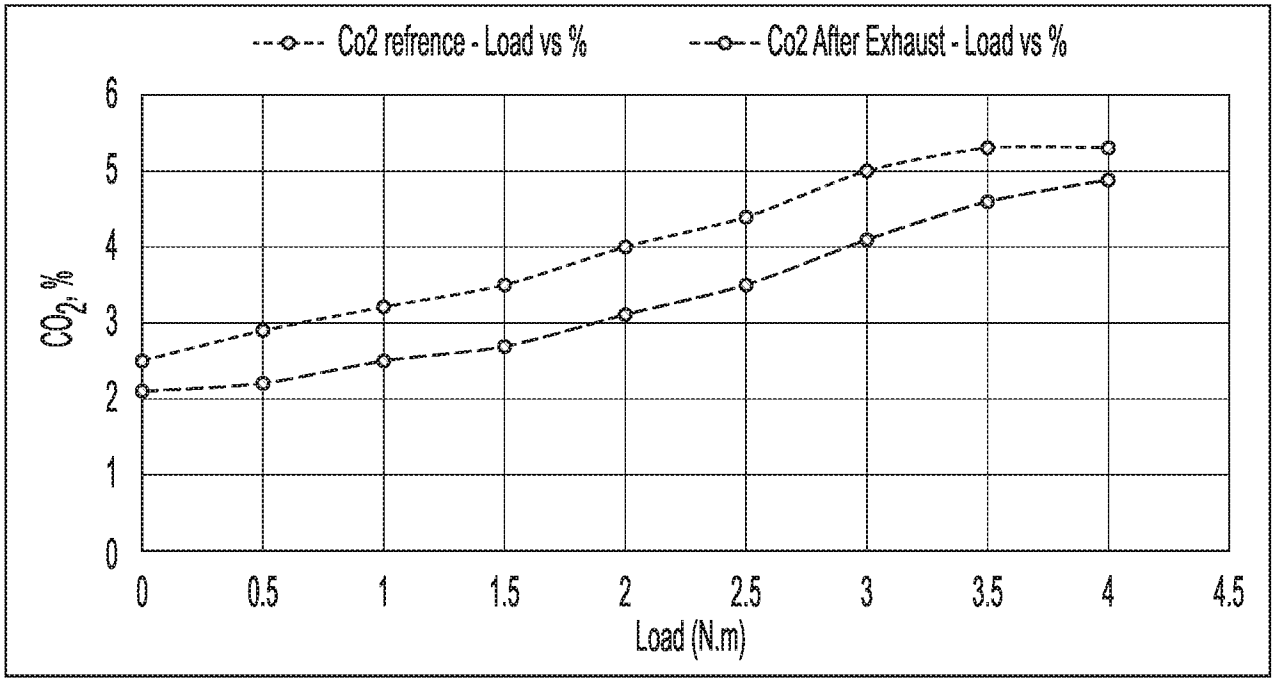
FIG. 11 illustrates carbon dioxide ($CO_2$) emissions of the diesel engine with and without installing the smokeless exhaust tube, according to certain embodiments.

FIG. 9 illustrates carbon monoxide (CO) emissions of the diesel engine with and without installing the smokeless exhaust tube, according to certain embodiments. Further, FIG. 10 illustrates HC emissions of the diesel engine with and without installing the smokeless exhaust tube, according to certain embodiments. In addition, FIG. 11 illustrates carbon dioxide ($CO_2$) emissions of the diesel engine with and without installing the smokeless exhaust tube, according to certain embodiments. As illustrated in FIG. 9, use of the smokeless exhaust tube may decrease CO emissions by about 20%, while the reduction in HC emissions were observed at low and high loads of the engine operation, as illustrated in FIG. 10. Moreover, FIG. 11 illustrates that $CO_2$ emissions decreased about 25% compared to the reference case over a wide range of engine operation when using the smokeless exhaust tube.

Figure 12:
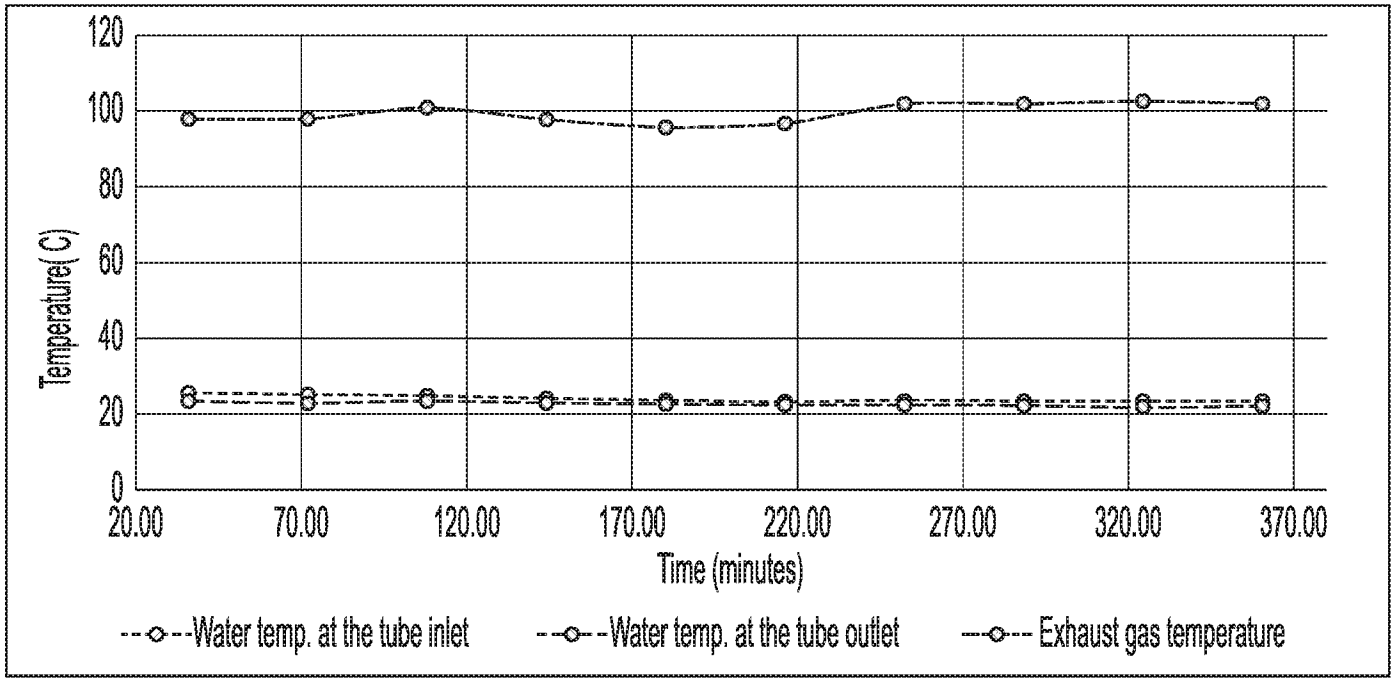
FIG. 12 illustrates measurements of the water temperature inside the outer tube of the smokeless exhaust tube in comparison with the exhaust temperature of the diesel engine, according to certain embodiments.

FIG. 12 illustrates measurements of the water temperature inside the outer tube of the smokeless exhaust tube in comparison with the exhaust temperature of the diesel engine, according to certain embodiments. In this case, the temperature of the water inside the outer tube was monitored at the inlet and exit of the smokeless exhaust tube to examine the effectiveness of the cooling system of the smokeless exhaust tube. In particular, FIG. 12 illustrates that even though the exhaust gas temperature out of the diesel engine was about 100° C., the water temperature inside the outer tube was about 25° C. during the entire engine operation. This provides evidence as to why the water remained inside the outer tube for more than 6 hours of operation without evaporation.

Figure 13:
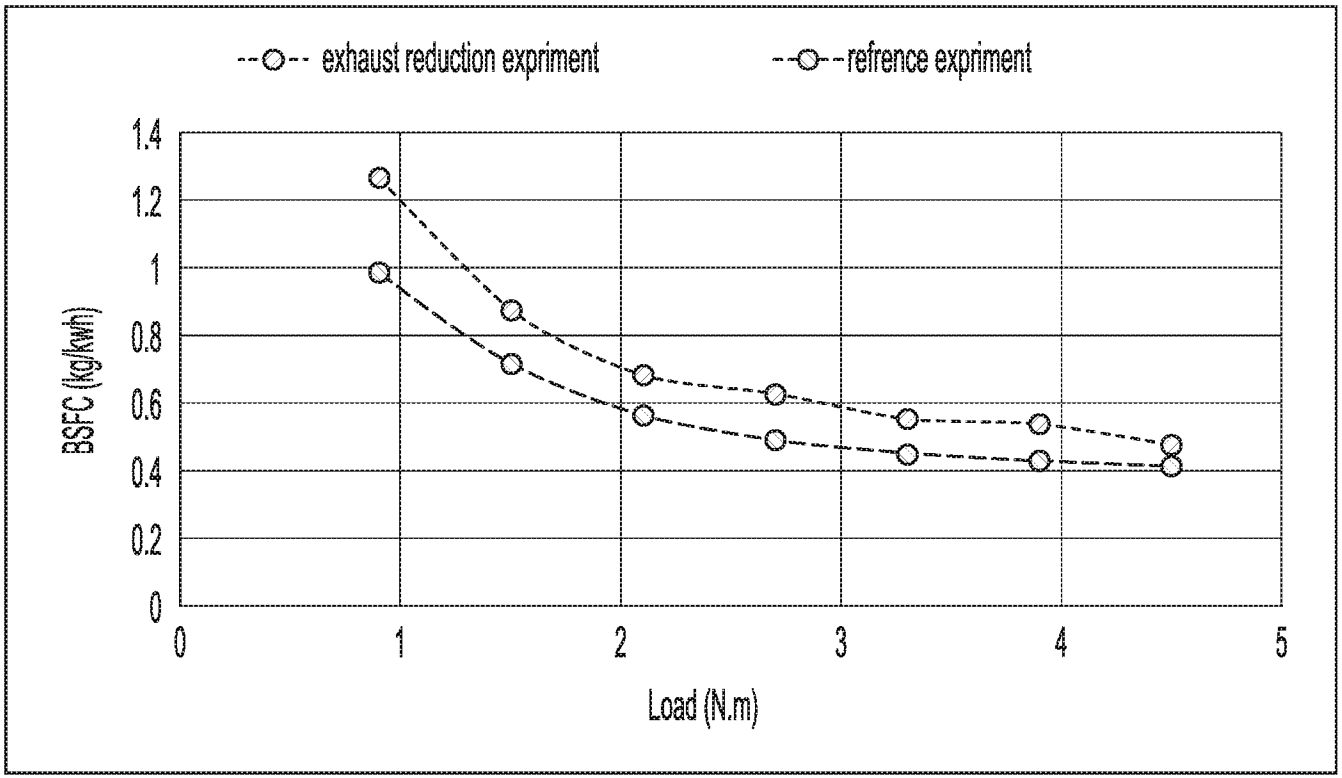
FIG. 13 illustrates the brake specific fuel consumption (BSFC) of the diesel engine with and without installing the smokeless exhaust tube, according to certain embodiments.

FIG. 13 illustrates the brake specific fuel consumption (BSFC) of the diesel engine with and without installing the smokeless exhaust tube, according to certain embodiments. In particular, FIG. 13 illustrates that when installing the smokeless exhaust tube, the fuel consumption of the engine increased about 10%-15% on average over the entire range of engine operation. This may be attributed to the water inside the tube creating a slightly higher pressure drop than under normal operation, which forces the engine to burn more fuel to generate the same power output.

Figure 14:
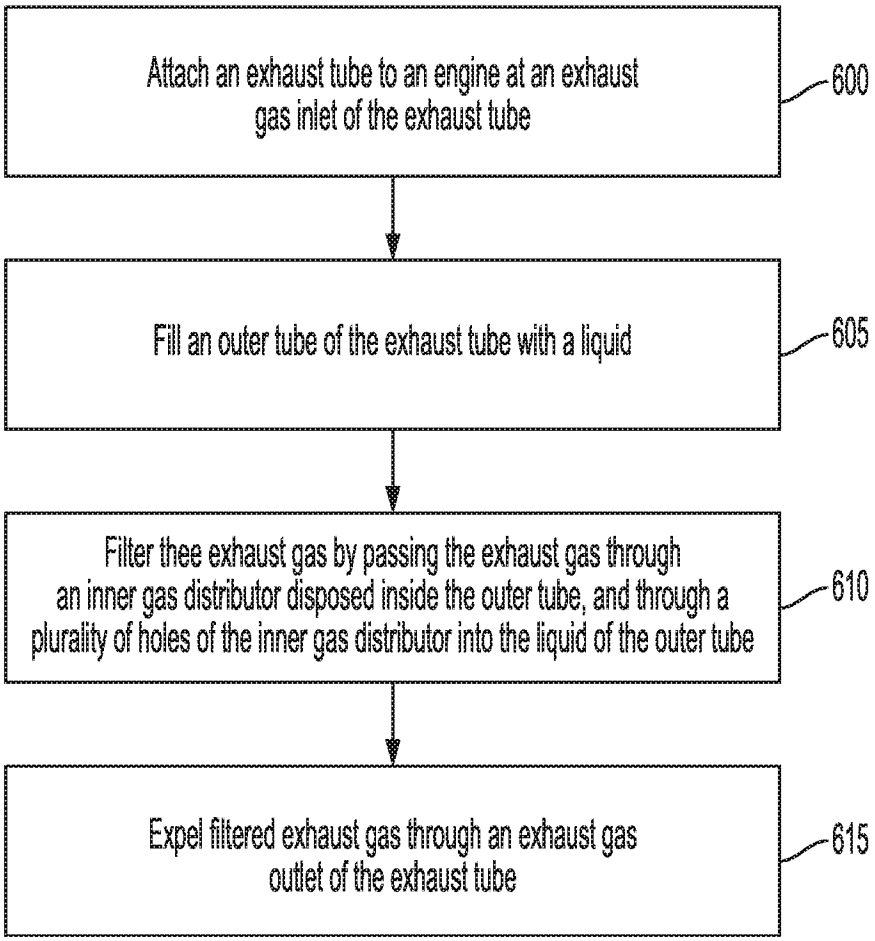
FIG. 14 illustrates a flow diagram of a method, according to an example embodiment.

FIG. 14 illustrates a flow diagram of a method, according to certain embodiments. The flow diagram of FIG. 14 may be performed by an exhaust tube. According to certain embodiments, the method of FIG. 14 may include, at 600, attaching an exhaust tube to an engine at an exhaust gas inlet of the exhaust tube. The method may also include, at 605, filling an outer tube of the exhaust tube with a liquid. In addition, the method may include, at 610, filtering the exhaust gas by passing the exhaust gas through an inner gas distributor disposed inside the outer tube, and through a plurality of holes of the inner gas distributor into the liquid of the outer tube. Further, the method may include, at 615, expelling filtered exhaust gas through an exhaust gas outlet of the exhaust tube.

According to certain embodiments, the method may also include installing an elbow component at the exhaust gas outlet. According to other embodiments, the method may include cooling the liquid with a cooling system. In certain embodiments, the method may also include attaching the cooling system to a radiator. In other embodiments, the method may include draining the liquid from the outer tube, and filling the outer tube with fresh liquid. According to certain embodiments, the method may further include attaching an external container to the outer tube. According to other embodiments, the method may include attaching a thermocouple device to the engine, the exhaust gas inlet, and the exhaust gas outlet.

Certain embodiments described herein provide several technical improvements, enhancements, and/or advantages. In some example embodiments, it may be possible to provide a smokeless exhaust tube that is capable of completely eliminating the smoke emissions of various equipment and diesel engines. In other embodiments, it may be possible to reduce other environmentally harmful emissions including, for example, $NO_x$, CO, and unburnt HC. According to further embodiments, it may be possible to provide a smokeless exhaust tube that can be used with stationary diesel engines, such as stationary electric generators driven by diesel engines to supply electricity to rural areas or for special purposes (e.g., stand-by generators in hospitals, festivals, ceremonies, etc.).

With certain example embodiments, it may be possible to provide improvements over the conventional technology. For instance, conventional technologies are dependent on different types of exhaust gas filters to reduce diesel engine smoke. These filters can manage to reduce large size carbon particles from the diesel smoke. However, the small size particles (e.g., soot with less than 5 μm diameter) cannot be eliminated by these filters in order not to affect operation of the engine. However, according to certain embodiments, it may be possible to remove these soot particles without affecting the engine operation. Moreover, it may be possible to reduce other harmful emissions such as $NO_x$, CO, and HC, which the existing filters cannot do.

One having ordinary skill in the art will readily understand that the invention as discussed above may be practiced with steps in a different order, and/or with hardware elements in configurations which are different than those which are disclosed. Therefore, although the invention has been described based upon these example embodiments, it would be apparent to those of skill in the art that certain modifications, variations, and alternative constructions would be apparent, while remaining within the spirit and scope of example embodiments.

I claim:

1. A method for filtering exhaust gas, comprising:

attaching an engine to an exhaust gas inlet attached to an outer tube of the exhaust tube;

filling the outer tube of the exhaust tube with water;

filtering the exhaust gas by passing the exhaust gas through an inner gas distributor disposed inside the outer tube, and through a plurality of holes of the inner gas distributor into the water of the outer tube;

expelling filtered exhaust gas through an exhaust gas outlet of the exhaust tube;

cooling the water with a cooling system, wherein the cooling system comprises a cooling coil submerged in the water of the outer tube;

attaching an external soot storage system configured to hold soot particles contained in the contaminated soot water to an exterior surface of the outer tube;

separating the soot particles of smoke of the exhaust gas from the contaminated soot water via a hydro-cyclone device of the external soot storage system by way of centrifugal force; and storing the soot particles in a container of the hydro-cyclone device after separation.

2. The method for filtering exhaust gas according to claim 1, further comprising installing an elbow component at the exhaust gas outlet.

3. The method for filtering exhaust gas according to claim 1, further comprising attaching the cooling system to a radiator.

4. The method for filtering exhaust gas according to claim 1, further comprising:

draining the water from the outer tube; and filling the outer tube with fresh water.

5. The method for filtering exhaust gas according to claim 1, further comprising attaching a thermocouple device to the engine exhaust gas, the exhaust gas inlet to the outer tube, and the exhaust gas outlet from the outer tube.

6. An exhaust tube, comprising:

an exhaust gas inlet on a first end of the exhaust tube;

an exhaust gas outlet on a second end of the exhaust tube opposite the first end;

an outer tube disposed between the exhaust gas inlet and the exhaust gas outlet, the outer tube comprising water and being attached to the exhaust gas inlet;

an inner gas distributor disposed inside the outer tube; and a cooling system disposed inside the outer tube configured to cool the water, wherein the cooling system comprises a cooling coil submerged in the water of the outer tube; and an external soot storage system configured to hold soot particles contained in the contaminated soot water, wherein the external soot storage system comprises a hydro-cyclone device configured to separate the soot particles of smoke of the exhaust gas from the contaminated soot water by way of centrifugal force, and wherein the hydro-cyclone device comprises a container configured to store the soot particles after separation.

7. The exhaust tube according to claim 6, wherein a surface of the inner gas distributor defines a plurality of holes.

8. The exhaust tube according to claim 6, further comprising an elbow component installed at the exhaust gas outlet.

9. The exhaust tube according to claim 6, further comprising an external container attached to the outer tube.

10. The exhaust tube according to claim 6, further comprising at least one thermocouple device.

11. The exhaust tube according to claim 6, wherein an exterior surface of the outer tube defines an upper hole and a bottom hole.

12. The exhaust tube according to claim 6, wherein the cooling system is attached to a radiator.

* * * * *